US005090431A

United States Patent [19]

Theroux et al.

[11] Patent Number: 5,090,431

[45] Date of Patent: Feb. 25, 1992

[54] CLEANING APPARATUS WITH VAPOR CONTAINMENT SYSTEM

[75] Inventors: Robert L. Theroux, Holyoke; Fatemeh Abnoosi, East Longmeadow, both of Mass.

[73] Assignee: K & M Electronics, Inc., West Springfield, Mass.

[21] Appl. No.: 531,937

[22] Filed: Jun. 1, 1990

[51] Int. Cl.[5] ..... B08B 3/10

[52] U.S. Cl. ..... 134/105; 134/182; 134/184; 134/200; 203/DIG. 5

[58] Field of Search ..... 134/105, 107, 184, 200, 134/182, 108; 203/DIG. 4; 68/18 C

[56] References Cited

U.S. PATENT DOCUMENTS

| | | | |
|---|---|---|---|
| 2,366,949 | 1/1945 | Woppman et al. | 134/105 X |
| 3,091,098 | 5/1963 | Bowers | 62/180 |
| 3,308,839 | 3/1967 | Barday | 134/107 X |
| 3,699,006 | 10/1972 | Hasslacher | 203/DIG. 4 |
| 4,137,929 | 2/1979 | Grossmann | 134/182 |
| 4,154,003 | 5/1975 | Muller | 68/18 C X |
| 4,267,022 | 5/1981 | Pitcher | 203/11 |
| 4,308,106 | 12/1981 | Mannfeld | 203/19 |
| 4,313,311 | 2/1982 | McCord | 62/197 |
| 4,345,971 | 8/1982 | Watson | 202/177 |
| 4,390,396 | 6/1983 | Koblenzer | 202/166 |
| 4,402,795 | 9/1983 | Erickson | 203/25 |
| 4,444,576 | 4/1984 | Ryan et al. | 62/20 |
| 4,499,743 | 2/1985 | Maestrelli | 68/18 C X |
| 4,512,814 | 4/1985 | Buck | 134/182 X |
| 4,532,983 | 8/1985 | Bradshaw et al. | 134/105 X |
| 4,556,457 | 12/1985 | McCord | 203/DIG. 4 |
| 4,626,321 | 12/1986 | Grethlein et al. | 203/26 |
| 4,645,569 | 2/1987 | Akabane et al. | 203/19 |
| 4,690,158 | 9/1987 | Yamada et al. | 134/107 |
| 4,695,349 | 9/1987 | Becker et al. | 203/DIG. 4 |
| 4,755,261 | 7/1988 | McCord | 203/DIG. 4 |
| 4,757,831 | 7/1988 | Ingermann et al. | 134/182 X |

OTHER PUBLICATIONS

Cole-Parmer Instrument Company 1989-1990 Catalog, Chicago, Il.

*Primary Examiner*—Frankie L. Stinson

*Attorney, Agent, or Firm*—Lahive & Cockfield

[57] ABSTRACT

A cleaning apparatus having a container for holding a quantity of cleaning agent, which is vaporized and condensed to form an upper vapor layer. Essentially, the container is divided into a lower chamber, for holding the cleaning agent, and an upper chamber for containing the vapors. One or more heat pumps are adapted to establish a relatively low temperature in the upper region to condense the vapors released by the lower heating process. Multiple high thermally conductive shunting devices are coupled between the high temperature end of the heat pumps and the bottom portion of the container to transfer extracted heat from the upper portion to the lower portion, to augment the vaporization process.

12 Claims, 2 Drawing Sheets

CLEANING APPARATUS WITH VAPOR CONTAINMENT SYSTEM

BACKGROUND OF THE INVENTION

This invention relates to cleaning apparatus, with vapor containment, for use when highly volatile and environmentally hazardous, and also non-environmentally hazardous materials are used as cleaning solvent, e.g., in removing flux from circuit board components and the like.

In the assembly of printed circuit boards, individual components are generally soldered into place using a tin-lead solder and a rosin flux. Following this operation, the assembled board is cleaned to remove all flux. Cleaning solvents in use today which are most efficient for such cleaning are environmentally hazardous. Chlorofluorocarbons and hydrochlorofluorocarbon may be used, the preferred substance being a FREON TM. FREON TM is an essentially stable, inert, non-flammable, non-explosive, and non-corrosive fluorocarbon product. In actual use, assembled circuit boards are typically lowered into liquid fluorocarbon or fluorocarbon vapor to effect cleaning.

Present systems for cleaning circuit boards are large, open cleaning tanks which have a basin of liquid cleaning agent, such as FREON TM. Conventional gas type refrigeration techniques are used to condense the vapor in order to prevent evaporation. A user places components to be cleaned into a carrier basket, which is then lowered into the vapor layer. All flux dissolves in the vapor and/or liquid, and is filtered out. In some present systems, filtered cleaning agent is recirculated and reused. To reduce the amount of vapor released to the environment by the open tanks of the prior art, users must slowly lower and raise the baskets. A typical rate is 11 inches per minute maximum. The vapor escape problem is compounded by vapor layer non-uniformities which occur in large cleaning tanks, i.e., the central region does not readily form and maintain a uniform vapor layer, primarily due to peripheral location of the heat pumps.

In addition to the environmental problems created by commercially available cleaning tanks, use of such tanks causes disruption in the production line. Due to the large size of the tanks, they are generally centrally located in a production facility. Thus, workers must leave work stations to walk over to the large tank. The slow rate at which components must be lowered into and raised out of the tank makes the entire cleaning process slow, resulting in the loss of valuable labor time. To avoid this loss of labor time, beakers of cleaning solvent are often placed at each work station. There are obvious disadvantages to such an arrangement, including vapor loss to the environment, and potential spills in the work environment. Thus, there is a need for an efficient, bench-top cleaning apparatus for use at a work station.

Accordingly, it is an object of the present invention to provide an improved cleaning apparatus with vapor containment.

It is another object of the invention to provide an efficient, environmentally safe bench-top cleaning apparatus for use in cleaning circuit boards.

SUMMARY OF THE INVENTION

These and other objects of the invention are accomplished by an improved cleaning apparatus with vapor containment for use when highly volatile and environmentally hazardous materials are used as cleaning solvent, e.g., in removing flux from circuit boards and the like.

The present invention is a cleaning apparatus having a container for holding a quantity of cleaning agent, which is vaporized and condensed to form an upper vapor layer. Essentially, the container is divided into a lower chamber, for holding the cleaning agent, and an upper chamber for containing the vapors. The chamber may be open to the environment at the top, for enabling introduction of the object to be cleaned, but without vapor escape.

The container of the invention maintains a relatively high temperature in the bottom portion, to vaporize the cleaning agent. One or more heat pumps are adapted to establish a relatively low temperature in the upper region to condense the vapors released by the lower heating process. Conducting metal bands may extend around the upper portion to evenly establish the low temperature. Multiple high thermally conductive shunting devices are coupled between the high temperature end of the heat pumps and the bottom portion of the container to transfer extracted heat from the upper portion to the lower portion, to augment the vaporization process.

Thus, the apparatus of the invention may include one or more heat pumps at the upper portion of the container to form the condensate of the upper vapor layer, while extracted heat from the upper heat pump provides sufficient heat to the lower portion of the container to vaporize the cleaning agent. An additional heat pump may be positioned near the lower portion to heat the cleaning agent.

Sidewall portions of the container may be made from low thermally conductive material and may include at least one layer of insulating material. The heat pumps may be solid state heat pumps for efficiency and economy.

BRIEF DESCRIPTION OF THE DRAWINGS

For a fuller understanding of the features, advantages, and objects of the invention, reference should be made to the following detailed description and the accompanying drawings, in which.

DESCRIPTION OF THE PREFERRED EMBODIMENT

Figure 1:
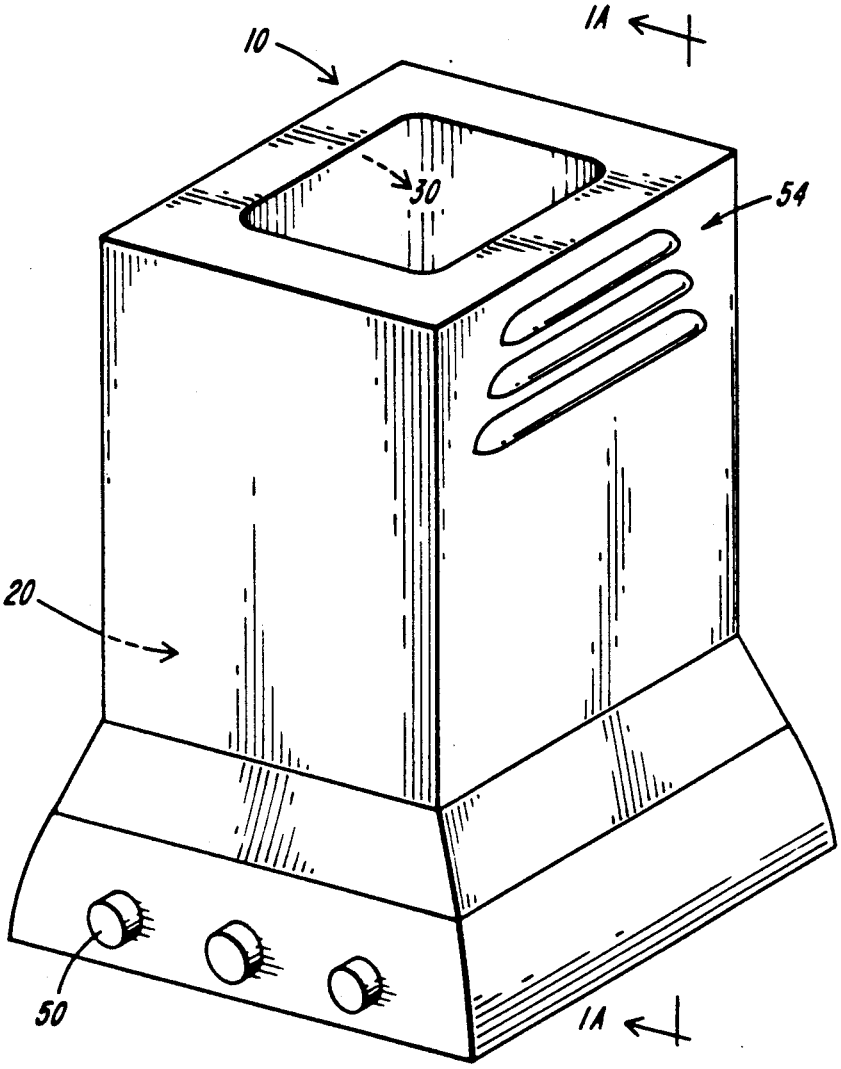
FIG. 1 is a perspective view of an embodiment of the apparatus of the present invention.
Figure 1A:
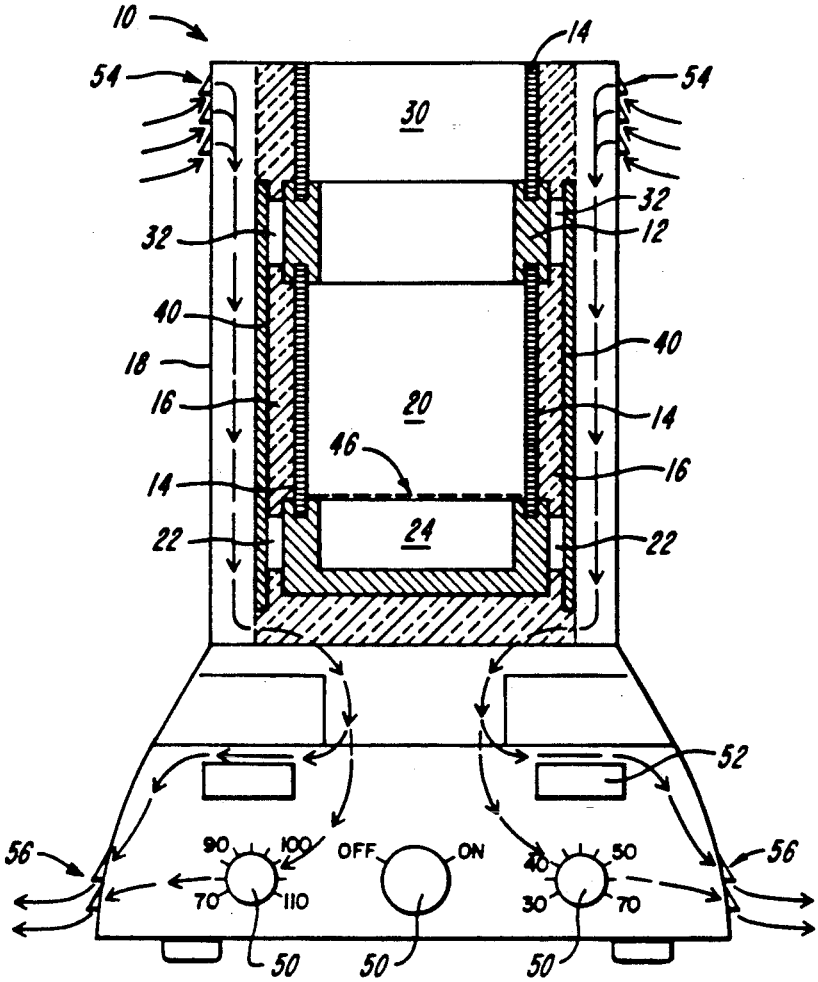
FIG. 1A is a schematic cut-away view of the embodiment of FIG. 1.

FIGS. 1 and 1A show perspective and cut-away views, respectively, of an embodiment of the invention. The overall dimensions of the apparatus are such that it may be positioned at a work station, or on a workbench adjacent to a work area. In the preferred embodiment, the dimensions are 4 inches wide, 5 inches long, and 8 inches high. At this scale, solid state components may economically be utilized. For example, solid state heat pumps may be employed as both the heating and cooling elements.

As shown in FIG. 1A, the apparatus 10 of the invention is a container having a lower vaporizing portion 20 and an adjacent upper condensing portion 30. The lower portion 20 may include a separate solvent containing portion 24 in which a cleaning agent, such as FREON TM, may be placed. An optional heating element 22 may be positioned adjacent to the solvent containing portion 24 to invoke vaporization. As the solvent is heated, vapors rise into the upper condensing portion 30 in which they encounter a relatively cold temperature front. The relatively cold temperature may be achieved by means of a cooling element 32, such as a solid state heat pump, having its cool end in good thermal contact with the regions. The container may be open at the top, or have a replaceable top cover (not shown).

The container of the apparatus 10 may consist of multiple alternating layers of insulating material and conductive material. In the illustrated embodiment, the apparatus has outer walls 18, thermal insulation 16, and inner walls 14. Between the outer walls 18 and insulation 16, thermally conductive heat sink straps 40 are positioned for shunting extracted heat from the hot end of upper heat pump 32 to the lower vaporizing portion 20. Thus, one embodiment of the apparatus, wherein element 22 is a high thermally conductive material, may rely solely upon one heat pump located adjacent to the upper portion 30, to provide both the relatively cool upper portion temperature for condensing vapor, and the relatively hot lower portion 20 temperature for vaporizing a cleaning agent. Alternatively, element 22 may be a hot plate or heating element placed adjacent to the lower portion 20 to bring the cleaning agent up to an initial vaporization temperature, after which point the heating element may be thermostatically turned off, and remaining heat may be shunted from the cooling element 32.

In the present embodiment, the apparatus 10 further includes a thermally conductive cooling band 12 around the circumference of the upper portion of the container adjacent to the cooling element 32. The cooling band 12 acts as a conductive material, so that heat is uniformly extracted by the cooling element 32 about the upper portion 30. In this manner, the stratification problem encountered by large units may be alleviated, and a relatively even distribution of condensed vapors may be established across the entire surface of the upper condensation portion 30.

Figure 2:
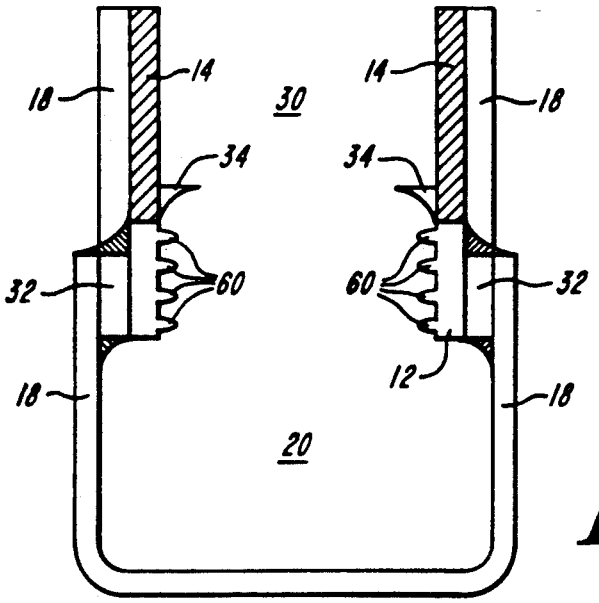
FIG. 2 is a schematic cut-away view of an alternate embodiment of the invention.

One problem encountered in large units is achieving vapor formation in the center of the condensation layer. An alternate form of the invention is shown, in part, in FIG. 2, including the upper and lower portions 20 and 30, together with the walls defining those portions. To assist with the stratification of condensed vapors, the inner wall of the cooling band 12 may have inwardly extending ridges 60, as shown in FIG. 2. Alternatively, or in conjunction with the ridges 60, the inner walls 14 may angle inward to form lips 34 which protrude into the bottom of the upper portion 30. The lips 34 serve a similar function to the ridges 60.

In one form of the invention, as shown in FIG. 1, the housing for the container 10 may further include multiple sets of louvres and an associated air flow path. In the illustrated embodiment, there are opposing sets of air input louvres 54 associated with the upper portion 30 of the container. Complimentary air output louvres 56 are then positioned near the bottom of the apparatus 10 to enable the circulation of air within the outer container walls 18. The louvres act as cooling means to prevent the heating and cooling elements from overheating. Alternatively, auxiliary fans (not shown) may be positioned about the container to serve a similar general cooling function. The type of cool-down arrangement used will be dependent upon the type of heating and cooling elements utilized. In the illustrated embodiment, solid state heat pumps are used as both the heating element 22 and the cooling element 32, with a louvre assembly providing the general cooling function.

Once the circuit board, or other element, is cleaned, the waste falls to the bottom of the container. In the illustrated embodiment, a stainless steel screen 46 is included to trap and filter the discarded waste. The screen may be periodically removed for cleaning. A tank drain (not shown) may be included at the base of the container for removal of dirty cleaning agent. The drain may lead to a filter unit which traps the waste material and enables the recirculation of cleaning agent.

The cooling band 12 may be manufactured from a metal, such as aluminum or stainless steel. Copper is the preferred metal for conducting energy, however it may be adversely affected by certain cleaning agents. Thus, copper may be plated with nickel, or other protective plating material, to preserve its conductive properties while protecting it from corrosion caused by the cleaning agent being used.

The outer container walls 18 may be manufactured from a non-conductive material. In the preferred embodiment, the outer walls are manufactured from ceramic plates, moldable ceramic, or a non-corrosive plastic. The inner wall may be manufactured from a low thermally conductive solvent-resistant material. In one aspect, solder or thermally conductive flexible epoxy may be used on all faces of the solid state heating element. Thermal grease may be applied to at least one face of each of the lower heating elements for stress, or shear, relief.

Also shown in FIG. 1 are temperature regulators 50, enabling an operator to manually control the temperature of both the optional lower heating element 22 and the upper cooling element 32. Feedback displays 52 may be included to provide important temperature monitoring of the upper and lower portions of the tank. While temperatures in the respective portions are relative, it is an important aspect of the invention that the temperature at the upper portion 30 remains low relative to the temperature of the lower portion 20. This assures that a vapor layer is maintained in the upper portion 30. For example, using FREON TM as the cleaning agent, optimal temperatures for the upper portion are in the range of from about 37°–45° F., and optimal temperature for the lower portion is above 104° F., or above the boiling point of the agent. The range in temperatures between the two container portions assures that a temperature differential will be maintained, even if there is fluctuation from the heating/cooling elements.

The invention can be embodied in other specific forms without departing from the spirit or essential characteristics thereof. The described embodiments of the invention are to be considered in all respects as illustrative and not restrictive, the scope of the invention being indicated by the appended claims rather than the foregoing description, and all changes which come within the meaning and range of equivalency of the claims are therefore intended to be embraced therein.

What is claimed is:

1. Apparatus for cleaning with vapor containment for vaporizing a liquid cleaning agent and condensing the resulting vapor, comprising:

a container for holding a quantity of cleaning agent, said container having a lower portion and sidewall portions vertically extending upward from and attached to said container, forming a continuous container wall, said container wall having an upper portion;

at least one cooling means for establishing and maintaining a relatively low temperature at said upper portion of said container wall;

at least one selectively operable temperature regulating means for maintaining a temperature differential between said upper portion and said lower portion;

at least one conducting means circumferentially extending around said upper portion of said container wall, said conducting means being positioned adjacent said cooling means for condensing said vapors and for providing a cold vapor blanket to prevent said cleaning agent loss by evaporation; and a shunting means for transferring heat from said cooling means to said lower portion of said container to provide heat to said lower portion.

2. Apparatus according to claim 1 wherein said cooling means includes solid state heat pumps.

3. Apparatus according to claim 1 wherein said sidewall comprises low thermally conductive material.

4. Apparatus according to claim 1 wherein said sidewall includes air circulating means.

5. Apparatus according to claim 4 wherein said air circulating means includes a plurality of air input louvres and a plurality of air output louvres.

6. Apparatus according to claim 1 wherein said cooling band comprises a thermally conductive material.

7. Apparatus according to claim 1 further comprising at least one heating means for maintaining a relatively high temperature at said lower portion of said container.

8. Apparatus according to claim 7 wherein said heating means includes solid state heat pumps.

9. Apparatus according to claim 1 further comprising inner side walls, said inner side walls including an opposing pair of inwardly angled lips at said upper portion.

10. Apparatus according to claim 1 further comprising inner side walls, said inner side walls having a plurality of ridges projecting into said upper portion.

11. Apparatus for cleaning with vapor containment for vaporizing a liquid cleaning agent and condensing the resulting vapor, comprising:

A. a substantially cupshaped container for holding a quantity of cleaning agent, said container having an interior region with an upper portion and a lower portion;

B. a first heat pump having a cool end and a hot end opposite thereto and means for thermally coupling said cool end to said upper portion whereby heat from said upper portion is transferred to said cool end and pumped to said hot end;

C. shunt means thermally coupled to said hot end for transferring heat from said hot end of said first heat pump to said lower portion.

12. The apparatus of claim 11 further comprising a second heat pump having a cool end and a hot end opposite thereto, and means for thermally coupling said shunt means to said cool end of said second heat pump and means for thermally coupling said hot end to said lower portion, whereby said heat transferred from said hot end of said first heat pump is received at said cool end of said second heat pump, and then pumped to said hot end of said second heat pump and transferred to said lower portion.

* * * * *